United States Patent [19]

Kelly et al.

[11] Patent Number: 4,731,714

[45] Date of Patent: Mar. 15, 1988

[54] LUMINAIRE

[75] Inventors: James P. Kelly, Waterford; James A. Wenman, Whitewater, both of Wis.

[73] Assignee: Cooper Industries, Houston, Tex.

[21] Appl. No.: 817,771

[22] Filed: Jan. 9, 1986

Related U.S. Application Data

[63] Continuation of Ser. No. 601,483, Apr. 18, 1984, abandoned.

[51] Int. Cl.[4] ..... F21V 15/04

[52] U.S. Cl. ..... 362/310; 362/263; 362/347; 362/147

[58] Field of Search ..... 362/310, 263, 347, 147, 362/311, 349, 300, 302, 297

[56] References Cited

U.S. PATENT DOCUMENTS

| | | | |
|---|---|---|---|
| 2,587,371 | 2/1952 | Nettestteia | 362/147 |
| 4,337,507 | 6/1982 | Lasker | 362/347 |
| 4,379,321 | 4/1983 | Plemmows | 362/310 |
| 4,379,322 | 4/1983 | Kelly | 362/310 |
| 4,398,239 | 8/1983 | de Vos | 362/263 |
| 4,414,616 | 11/1983 | de Vos | 362/310 |

*Primary Examiner*—Carl Stuart Miller

*Attorney, Agent, or Firm*—E. E. Scott; A. R. Thiele

[57] ABSTRACT

A luminaire includes a housing defining a cavity with an open end. A double acting reflector system is mounted in the cavity that includes a first reflector of a generally concave configuration. A light source is positioned in the upper portion of the cavity. The first reflector is configured to capture a substantial portion of the light emanating from the light source and reflect it downward. The reflector system also includes a second reflector extending down from a lower rear edge of the first reflector. The second reflector is configured to capture a portion of the light projected from the first reflector and reflect it outwardly and downwardly to help form a rectangular lighting pattern on a planar surface. A transparent, nonprismatic lens is included which is secured to the housing to cover the open end. The housing may include an aperture with a removable plug to provide access to the light source for connection of wires and the like.

14 Claims, 7 Drawing Figures

FIG. 1
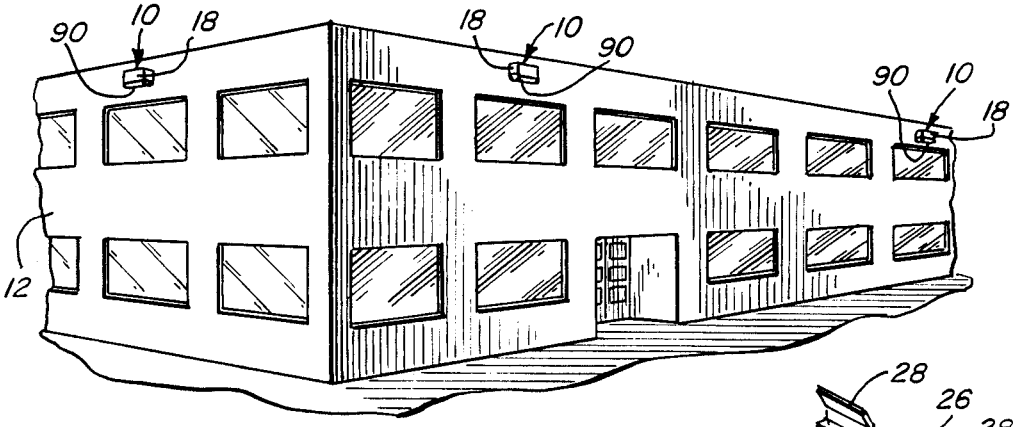
FIG. 2
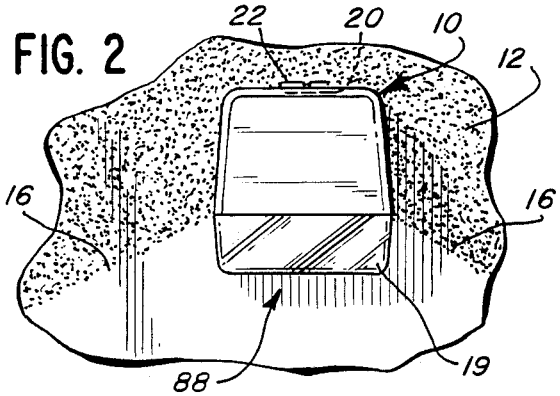
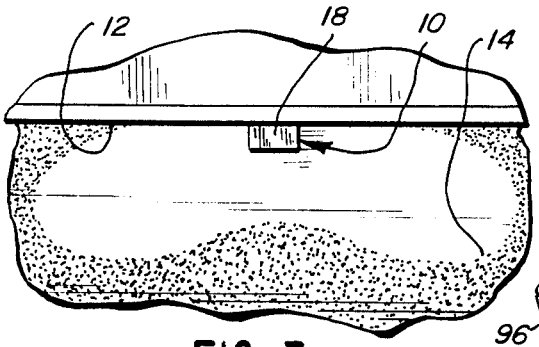
FIG. 3
FIG. 4
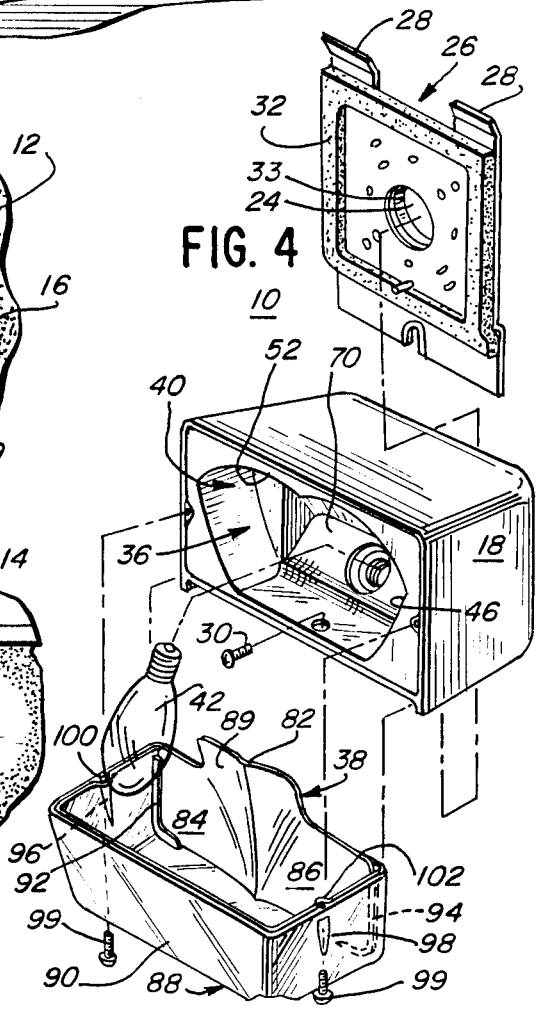

LUMINAIRE

This application is a continuation of application Ser. No. 601,483, filed Apr. 18, 1984, now abandoned.

BACKGROUND OF THE INVENTION

The present invention relates to a new and improved luminaire and more particularly, to a new and improved luminaire including a double acting reflector system and a clear, nonprismatic lens assembly. With this reflector system and lens assembly, the luninaire projects light downwardly in a generally rectangular pattern with a sharp horizontal cutoff.

Many buildings and facilities employ protective security lighting to protect the premises. These buildings and facilities have open access to the public and as a result, can be vandalized or entered by intruders. In many cases, the protecive security lighting system constitutes the only security system.

Effective protective security lighting systems discourage or deter intruder attempts by making the intruder believe that detection by building occupants, passing pedestrians or police, or a regular night watchman will be inevitable, if entry into the area occurs. These systems should offer their users reliability, and failure of a single lamp or lamps should not create a large dark area vulnerable to intrusion. Consequently, well defined side light from each luminaire in the lighting system is desirable.

Although high visibility is desired, protective lighting should not create glare or spill light. It is usually necessary in protective lighting to avoid light pollution since zoning laws have become so mixed that in many areas industrial, commercial and residential districts often overlap or closely adjoin. Light spilling over into a residential section from protective lighting can be both annoying and disruptive. Consequently, many cities have adopted ordinances designed to reduce light pollution.

One desirable way to provide protective lighting while avoiding light pollution is the use of wall mounted luminaires which provide an asymmetrical generally rectangular light pattern normally classified as an IES/ANSI type III distribution. Since with this type of lighting, glare or light spilling increases as the vertical height of the luminaire and the vertical angle of flux emission increases, control of the candlepower distribution is very desirable. Such control may be accomplished with cutoff techniques.

Light distribution in luminaires is often accomplished through the use of a prismatic lens. An example of this use of a prismatic lens is disclosed in U.S. Pat. No. 4,398,239. Prismatic lenses are not the most effective way to control light distribution, since these lenses tend to scatter light randomly, thereby sending light into unneeded or unwanted areas and resulting in an uneven light pattern. To overcome the inefficienty of scattered light and to obtain the desired light level in the desired area, a larger than necessary amount of energy is required and used by these luminaires.

Additional energy is lost in luminaires using prismatic lenses, since the prims may reflect almost onehalf of the light back into the fixture. Much of this light is lost in the fixture in the form of heat.

SUMMARY OF THE INVENTION

An object of the present invention is to provide a new and improved luminaire.

Another object of the present invention is to provide a new and improved luminaire that controls light pollution and spilling.

A further object of the present invention is to provide a new and improved luminaire that controls light spilling and light pollution with a clear lens and a double acting reflector system.

Briefly, the present invention is directed to a new and improved luminaire including a housing defining a cavity with an open end. A double acting reflector system is provided with a first generally concave portion mounted in the cavity. The reflector system includes a second portion at the lower edge of the housing extending down from the first portion.

A high intensity discharge lamp is mounted high in the cavity. The first portion of the reflector system captures and reflects a large portion of the bare lamp light onto the second portion of the reflector system. The second portion of the reflector system reflects light forwardly and downwardly from the luminaire.

The luminaire also includes a lens assembly. The lens assembly includes a multiplanar, clear lens which encases the open end of the housing.

The luminaire of the present invention may be mounted on a wall of a building to provide security lighting. A back mounting plate is removably secured to the housing for mounting and wiring. The housing also includes a pipe tapped conduit opening to allow power entry into the housing from the top.

BRIEF DESCRIPTION OF THE DRAWINGS

FIG. 1 is a pictorial illustration of luminaires constructed in accordance with the present invention mounted on a building or similar facility;

FIG. 2 is a view of a luminaire of the present invention illustrating the mounting and light pattern;

FIG. 3 is a view of the pattern of light on a planar surface generated by the luminaire of the present invention;

FIG. 4 is an exploded view of the luminaire of the present invention;

DETAILED DESCRIPTION OF THE PREFERRED EMBODIMENT

Figure 5:
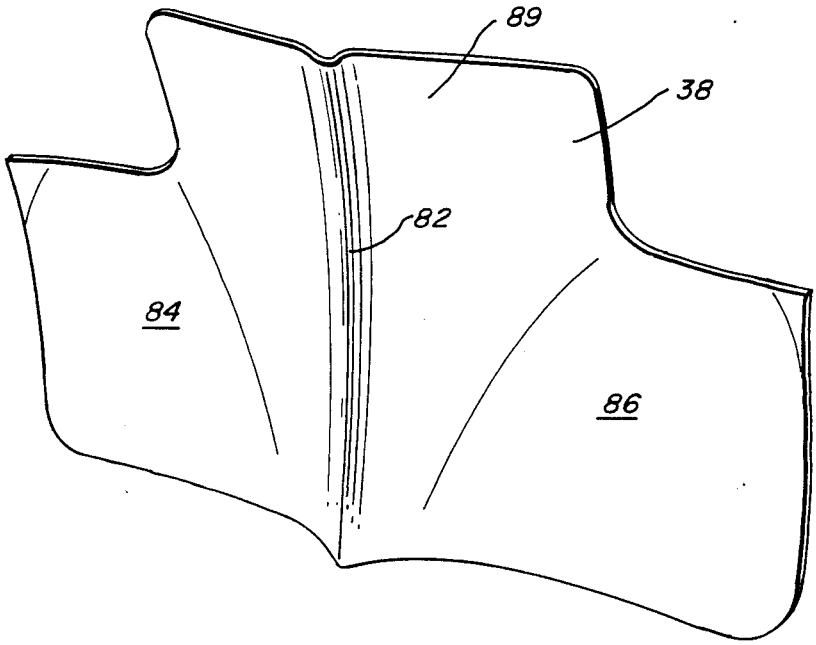
FIG. 5 is an enlarged, perspective view of the lower reflector in a luminaire of the present invention.

Referring to the drawings and particularly to FIGS. 1–4, there is illustrated a luminaire generally designated by the reference numeral 10. Several luminaires 10 may be mounted on the facade of a building 12 to provide a security lighting system. It is to be understood that although luminaire 10 is illustrated in the preferred embodiment as wall mounted, other forms of mounting are feasible and may be employed.

Luminaire 10 focuses light downwardly in an asymetrical generally rectangular pattern 14 normally classified as an IES/ANSI type III pattern. To avoid light pollution, luminaire 10 is designed to provide a sharp horizontal cutoff attained by reflector optics. Luminaire 10 is also designed to have good definition distribution on its side throw light as indicated by lines 16—16 (FIG. 2), such that light from one luminaire 10 fades into the light from an adjacent luminaire 10.

Turning to FIG. 4, the components of luminaire 10 are illustrated. Luminaire 10 includes a housing assembly 18 which is preferably fabricated of durable material and of one piece to withstand harsh weather and to minimize leakage into housing assembly 18. Housing assembly 18 houses lamp ballast components and similar elements (not shown) and includes a pipe tapped conduit opening 20 on the top that is normally plugged by a plug 22. Supply wires (not shown) are normally fed from a junction box in wall 12 behind the luminaire 10, through an aperture 24 in a mounting plate 26 and to the lamp ballast components. If, due to the mounting of luminaire 10, it is easier to feed supply wires through the top of housing assembly 18, plug 22 may be removed and supply wires fed through opening 20.

Mounting plate 26 clips onto housing assembly 18 by ears 28. Housing assembly 18 may then be secured to mounting plate 26 at the bottom by a single fastener 30. Mounting plate 26 includes on both sides gaskets 32 and 33, that seal against housing assembly 18 and wall 12 to protect against leakage and to further weatherproof housing assembly 18.

Figure 7:
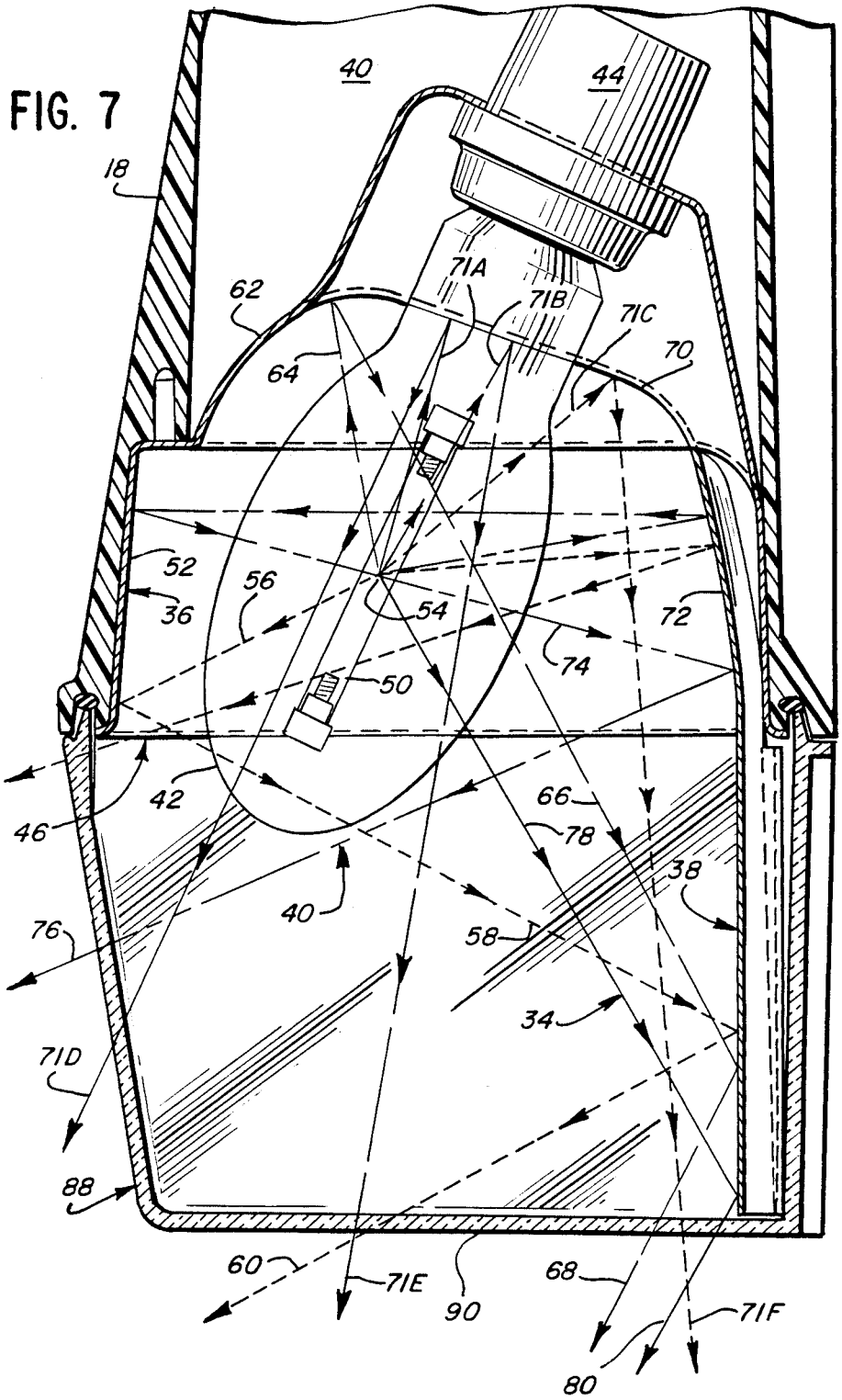
FIG. 7 is an enlarged, vertical cross sectional view of a luminaire of the present invention illustration ray traces of the light generated in the luminaire.

Reflection downward and the sharp horizontal cutoff in luminaire 10 are accomplished by reflector optics. Luminaire 10 includes a double acting reflector system generally designated by the reference numeral 34 (FIG. 7). Reflector system 34 may be one piece or multiple piece. In the preferred embodiment illustrated, reflector system 34 includes a top or main reflector 36 and a lower or secondary reflector 38.

Top reflector 36 is mounted in a cavity 40 defined by housing assembly 18. Refelctor 36 surrounds a lamp 42 mounted in a socket 44 and includes an opening 46. Lamp 42 may be a high intensity discharge lamp with a gaseous discharge arc tube 50. The most preferred of the high intensity discharge lamps for luminaire 10 is a high presure sodium lamp, due to the high energy efficiency of these lamps. The reflector 36 captures more than sixty percent of the bare lamp lumens emanating from lamp 42, and projects most of this light onto lower reflector 38. To illustrate the ray pattern inside reflector 36, reference is made to FIG. 7. Lamp 42 is mounted high in the reflector to provide the sharp cutoff desired. In this portion, a large amount of the light is reflected off a curved surface 52 of top reflector 36, since this surface 52 is adjacent the side of lamp 42. Rays emanating from the light center 54 of lamp 42, such as ray 56, are reflected back and downwardly from reflector surface 52 onto lower reflector 38, as indicated by ray 58, and are reflected forwardly and downwardly from luminaire 10 by lower reflector 38, as indicated by ray 60.

Top reflector 36 also includes a front curvilinear surface 62 which reflects light from lamp center 54, such as ray 64, onto lower reflector 38, as indicated by ray 66. Ray 66 is reflected from surface 62 onto lower reflector 38 and forwardly and downwardly from reflector 38 and out of luminaire 10 as ray 68.

A rear curvilinear surface 70 of top reflector 36 reflects light rays 71A, 71B and 71C from lamp center 54, directly out of open end 46 of cvity 40 as rays 71D, 71E and 71F, respectively.

Some light emanating from lamp center 54 is also reflected directly off lower reflector 38. For example, the rear generally planar surface 72 of bottom reflector 38 reflects light from the lamp center 54, such as ray 74, outwardly and downwardly as ray 76. Ray 78 is reflected off reflector 38 forwardly and downwardly as ray 80.

Lower reflector 38, in the preferred embodiment, is separate from top reflector 36. It should be understood, however, that top reflector 36 and lower reflector 38 may be integral if desired. To obtain the desired side light definition, lower reflector 38 includes a central peak 82 with downwardly curving side portions 84 and 86 (FIG. 5). Lower reflector 38 also includes a forwardly extending portion 89. Peak 82 insures proper side light dispersion of light reflected off of lower reflector 38, since if the central area of reflector 38 were flat, light would be reflected straight out from the reflector in a relatively narrow beam. With peak 82, side portions 84 and 86 reflect light out to the sides of luminaire 10 providing a wider pattern of light. The wide beam also helps to avoid a dark spot if one of a plurality luminaires 10, as in FIG. 1, fails.

Figure 6:
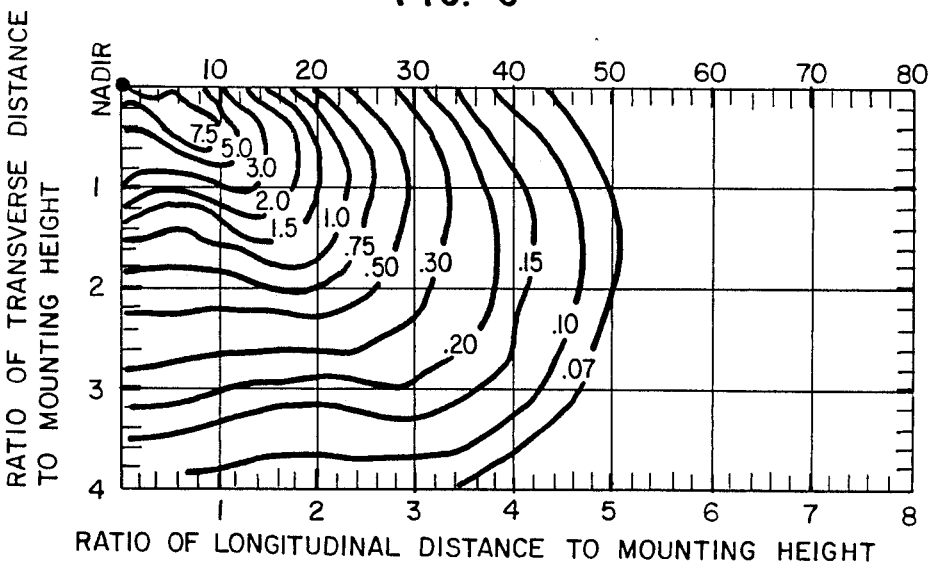
FIG. 6 is an isofootcandle diagram for a luminaire of the present invention.

The pattern of light produced by liminaire 10 is plotted in the isofootcandle diagram in FIG. 6. The mounting height of the luminaire 10 which is plotted in FIG. 6 is fifteen feet. As the diagram illustrates, the light pattern is substantially asymetrical. Lines of equal footcandle illumination at various distances from luminaire 10 are plotted by the curvilineare lines in FIG. 6.

Since luminaire 10 employs reflector optics to obtain the desired light pattern and cutoff, a clear, nonprismatic lens assembly generally designated by the reference numeral 88 is used (FIGS. 4 and 7). Lens assembly 88 includes a multiplanar, nonprismatic lens 90 fabricated of a clear, tranpsarent material, such as clear acrylic, a polycarbonate or glass. Lens 90 is of a size and configuration to enclose opening 46 of cavity 40. Lower reflector 38 is removably positioned in lens 90 and is frictionally held by flanges 92 and 94, defined on the interior surface of lens 90. Lens 90 includes indentations 96 and 98 with apertures 100 and 102 through which fasteners 99 may be positioned to secure lens 90 to housing assembly 18. Since lens 90 is nonprismatic, there is little or no scattering of light and a minimum of light reflected back into cavity 40. Consequently, luminaire 10 is very efficient.

While a particular embodiment of the invention has been shown and described, it should be understood that the invention is not limited thereto, as modifications may be made. It is therefore contemplated to cover by the present application, any and all such modifications as fall within the true spirit and scope of the appended claims.

We claim:

1. A luminaire adapted to a luminate a planar area with a sharp horizontal cutoff in a generally rectangular light pattern, comprising:

a housing defining a cavity with a downwardly facing open end;

a source of light located in an upper portion of said cavity;

means for mounting said housing on a vertical surface;

a reflector system, said reflector system including a first top reflector portion in said cavity;

said reflector system further including a lower second reflector portion extending downwardly from said cavity;

a lens assembly secured to said housing over said downwardly facing open end, said lens assembly including a lens of transparent, nonprismatic substantially smooth material;

said second portion of said reflector system being removably mounted in said lens assembly;

said first portion of said reflector system including a substantially concave reflector shaped to conform to the internal periphery of said cavity, said first portion of said reflector system further being constructed and arranged to reflect light from said source of light onto said second portion of said reflector system;

said second portion of said reflector system including side edges, a central peak with curvilinear side sections curving downwardly from said central peak to said side edges and a forwardly extending portion;

said first portion of said reflector system including a frontal surface configured to reflect light out of said downwardly facing open end of said housing and onto said second portion of said reflector system, said first portion of said reflector system including a rear surface configured to reflect light out of said downwardly facing open end of said housing through said lens assembly in a generally outward and downward direction.

2. A double acting reflector system for a luminaire which projects a substantially rectangular light pattern onto a planar surface having a substantially sharp horizontal cutoff, comprising:

a first reflector section;

said first reflector section being generally concave with top, back, and side portions and a lower portion with an open end;

said first reflector section being configured to substantially surround a source of light; and a second reflector section of a generally symmetrical configuration extending from said lower and back portions of said first reflector section, said second reflector section constructed and arranged to receive and further reflect light rays reflected from said first reflector section;

said second reflector section including side edges, a central peak with curvilinear side portions curving downwardly from said peak to said side edges and a forwardly extending portion;

a lens assembly;

said lens assembly including a multi-planar, nonprismatic lens removably secured to said second reflector section.

3. A wall mounted luminaire, comprising:

a housing, said housing defining a cavity;

a source of light located high in said cavity;

a double acting reflector system;

a lens assembly including a multi-planar, transparent, nonprismatic lens;

said double acting reflector system including a main reflector of generally concave configuration mounted in said cavity in said housing substantially surrounding said source of light;

said double acting reflector system further including a lower reflector below said cavity in said housing;

said main reflector having a configuration t capture light emanating from said source of light and to reflect a substantial portion of said light onto said said lower reflector;

said lower reflector having a configuration to capture said light reflected from said main reflector and project said light outwardly and downwardly.

4. A luminaire adapted to luminate a planar area with a sharp horizontal cutoff in a generally rectangular light pattern, comprising:

a housing defining a cavity with a downwardly facing open end;

a source of light located in an upper portion of said cavity;

means for mounting said housing on a vertical surface;

a reflector system, said reflector system including a first top reflector portion in said cavity;

said reflector system further including a lower second reflector portion extending downwardly from said cavity;

a leans assembly secured to said housing over said downwardly facing open end, said lens assembly including a lens of transparent, nonprismatic substantially smooth material;

said second portion of said reflector system being removably mounted in said lens assembly;

said first portion of said reflector system including a substantially concave reflector shaped to conform to the internal periphery of said cavity, said first portion of said reflector system further being constructed and arranged to reflect light from said source of light onto said second portion of said reflector system;

said second portion of said reflector system including side edges, a central peak with curvilinear side sections curving downwardly from said central peak to said side edges and a forwardly extending portion;

said first portion of said reflector system including a front surface configured to reflect light downwardly onto said second portion of said reflector system, said first portion of said reflector system further including a back surface below said source of light configured to reflect light out of said downwardly facing open end of said housing and through said lens assembly.

5. The luminaire as defined in claim 1, wherein said housing further includes an aperture for access to the interior of said housing and, a plug removably positioned in said aperture.

6. The luminaire as defined in claim 1, further including a mounting plate removably clipped to said housing and secured thereto by a single fastener.

7. The reflector system as defined in claim 2, wherein said first reflector section is constructed and arranged to capture a substantial portion of light emanating from said source of light and project a substantial portion of said light emanating from said first reflector section onto said second reflector section.

8. The reflector system as defined in claim 2, wherein said second reflector section is constructed and arranged to capture light projected from said first reflector section and project said light outwardly and downwardly.

9. The reflector system as defined in claim 2, wherein said first and second reflector sections are separate members.

10. The luminaire as defined in claim 3, wherein said lower reflector is slidably mounted within said lens assembly.

11. The luminaire as defined in claim 3, wherein said source of light is located high in said cavity of said housing.

12. The luminaire as defined in claim 3, wherein said lower reflector includes a central peak with curved side portions and a forwardly extending portion.

13. The luminaire as defined in claim 4, wherein said housing further includes an aperture for access to the interior of said housing and, a plug removably positioned in said aperture.

14. The luminaire as defined in claim 4, further including a mounting plate removably clipped to said housing and secured thereto by a single fastener.

* * * * *